US008869708B1

(12) United States Patent
Meyer

(10) Patent No.: US 8,869,708 B1
(45) Date of Patent: Oct. 28, 2014

(54) MODEL RAILROAD FLASHING REAR END DEVICE

(76) Inventor: Daniel P. Meyer, Pittsburgh, PA (US)

( * ) Notice: Subject to any disclaimer, the term of this patent is extended or adjusted under 35 U.S.C. 154(b) by 98 days.

(21) Appl. No.: 13/594,733

(22) Filed: Aug. 24, 2012

Related U.S. Application Data

(60) Provisional application No. 61/527,797, filed on Aug. 26, 2011.

(51) Int. Cl.
*A63H 19/20* (2006.01)

(52) U.S. Cl.
CPC ..... *A63H 19/20* (2013.01)
USPC ..... 105/157.2; 246/473 A; 446/438

(58) Field of Classification Search
CPC ..... A63H 19/20; A63H 19/22
USPC ..... 105/1.5, 29.2, 157.2; 246/1 C, 473 A; 446/438
See application file for complete search history.

(56) References Cited

U.S. PATENT DOCUMENTS

| | | | | |
|---|---|---|---|---|
| 3,675,586 | A * | 7/1972 | Haddad | 104/300 |
| 5,373,791 | A * | 12/1994 | Bach et al. | 104/288 |
| 5,746,642 | A * | 5/1998 | Grapp | 446/438 |
| 7,549,609 | B2 * | 6/2009 | Ring | 246/1 C |
| 2004/0238694 | A1 * | 12/2004 | Ring | 246/131 |
| 2004/0255816 | A1 * | 12/2004 | Chenier | 105/157.2 |
| 2010/0041308 | A1 * | 2/2010 | Kumegawa | 446/438 |

* cited by examiner

*Primary Examiner* — Zachary Kuhfuss
(74) *Attorney, Agent, or Firm* — Nils H. Ljungman & Associates

(57) ABSTRACT

A model railroad car flashing rear end device contained entirely on or about the model railroad car truck and powered by the model railroad track rails. The abstract of the disclosure is submitted herewith as required by 37 C.F.R. §1.72(b). As stated in 37 C.F.R. §1.72(b): A brief abstract of the technical disclosure in the specification must commence on a separate sheet, preferably following the claims, under the heading "Abstract of the Disclosure." The purpose of the abstract is to enable the Patent and Trademark Office and the public generally to determine quickly from a cursory inspection the nature and gist of the technical disclosure. The abstract shall not be used for interpreting the scope of the claims. Therefore, any statements made relating to the abstract are not intended to limit the claims in any manner and should not be interpreted as limiting the claims in any manner.

20 Claims, 9 Drawing Sheets

MODEL RAILROAD FLASHING REAR END DEVICE

BACKGROUND

1. Technical Field

The present application is in the field of model railroading. More particularly, the present application is in the field of flashing rear end devices for model train cars.

2. Background Information

Creating realistic models of actual, full size trains has been the focus of the model railroad industry for many years. The industry has determined that several sizes or scales, of model trains are standard and well accepted. Some representative examples of these sizes or scales are HO scale, N scale and Z scale. These scales are often expressed in a ratio of real full size measurement to the scale model measurement. For example a real foot (12 inches) compares to 87 scale feet in HO scale. In N scale that same real foot (12 inches) compares to 160 scale feet. For Z scale, one foot (12 inches) compares to 220 scale feet. These real to scale comparisons can also be expressed as a linear ratio, such as 1:87 for HO scale or 1:160 for N scale and 1:220 for Z scale.

In addition to accurately scaling model railroad apparatus, the industry has also attempted to make model railroads operate like the full-size prototype. When the flashing rear end device was created to replace the caboose as the last part of a train, the model railroad industry followed. A model flashing rear end device like the prototype was now desired.

Conventional model railroad flashing rear end devices are typically installed in the interior of a model railroad car. Typically, a light source protrudes from the inside of the model railcar and out the rear wall. The light source may be an incandescent light bulb, a light emitting diode (LED) or a fiber optic filament. It is difficult to move these devices from one model railcar to another because they are permanently installed. Further, these devices are typically powered by a battery. This battery is installed in the interior of the model railcar. To preserve battery life, a power switch of some kind is utilized.

Another approach to powering the flashing rear end device is to use the track power. There are currently two types of power used in model railroading, digital and analog. Digital power is a newer system, wherein an alternating current with a digital data packet is applied to the rails. This system provides constant current and voltage to the track. The older type of power is analog, wherein a direct current is applied to the track and speed and direction are controlled by voltage and polarity selected.

In real, full-size railroading as well as in model railroading, there are different components with specific names used when referring to the vehicles that operate on the rails. A railcar can be any shape, size or geometry provided it has the following main components: a car body, two couplers, and two or more trucks or wheel assemblies. The car body is the main part of the railcar and is for the conveyance and protection of the goods being carried by the railcar.

The couplers are found at the extreme ends of the railcar, and are used to attach the railcar to another railcar, making a train. In real, full-sized railroading, the couplers are always attached to the car body, but in model railroading, the coupler may be attached to the car body or attached to the truck (wheel assembly).

The railcar truck is the wheel assembly found under the car body, usually near the ends, that supports the car body above the rails of the track that the railcar operates upon. This truck typically is used in a paired arrangement with one truck under each end of the car body, and may have one, two or more axles with two wheels attached to each axle.

In model railroading, the design of the model railcar truck and the model railcar coupler may be two separate pieces or assemblies or may be integrated into one unit. Since the assemblies must be attached in some manner to the car body, more than one fastener is needed if there is more than one assembly. An integrated design for the truck-coupler assembly can be seen in FIG. 2. and U.S. Pat. No. 3,564,766, Feb. 23, 1971, C. K. Edwards, et. al., which patent is incorporated by reference. This design uses only one fastener to attach to the car body, called a kingpin, which is part number 12 in the cited patent. Prior art can be illustrated to apply to a two-piece design, but not to an integrated unit design.

SUMMARY

The present application relates to a model railroad car flashing rear end device that is contained entirely on or about the model railcar truck (wheel assembly) for N Scale (1:160) and Z scale (1:220) and is powered by electrical current and voltage obtained from the model railroad track rails, via wipers or contacts that touch the wheels. The power is conditioned and then used to power a LED or similar device mounted on or about the truck.

The above-discussed embodiments of the present invention will be described further hereinbelow. When the word "invention" or "embodiment of the invention" is used in this specification, the word "invention" or "embodiment of the invention" includes "inventions" or "embodiments of the invention", that is the plural of "invention" or "embodiment of the invention". By stating "invention" or "embodiment of the invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

DESCRIPTION OF EMBODIMENT OR EMBODIMENTS

Figure 1:
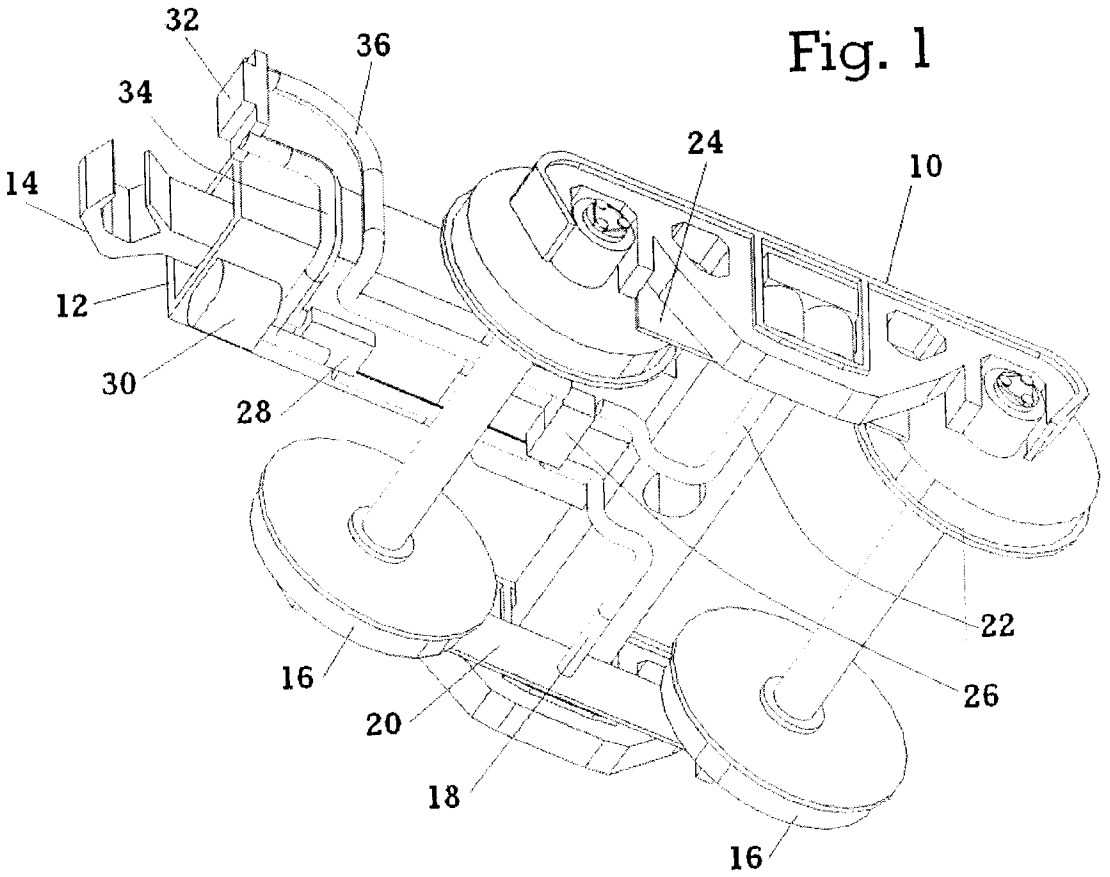
FIG. 1 is a perspective view of a possible embodiment of the device installed on a model railcar truck, showing the lower side of the truck.
Figure 2:
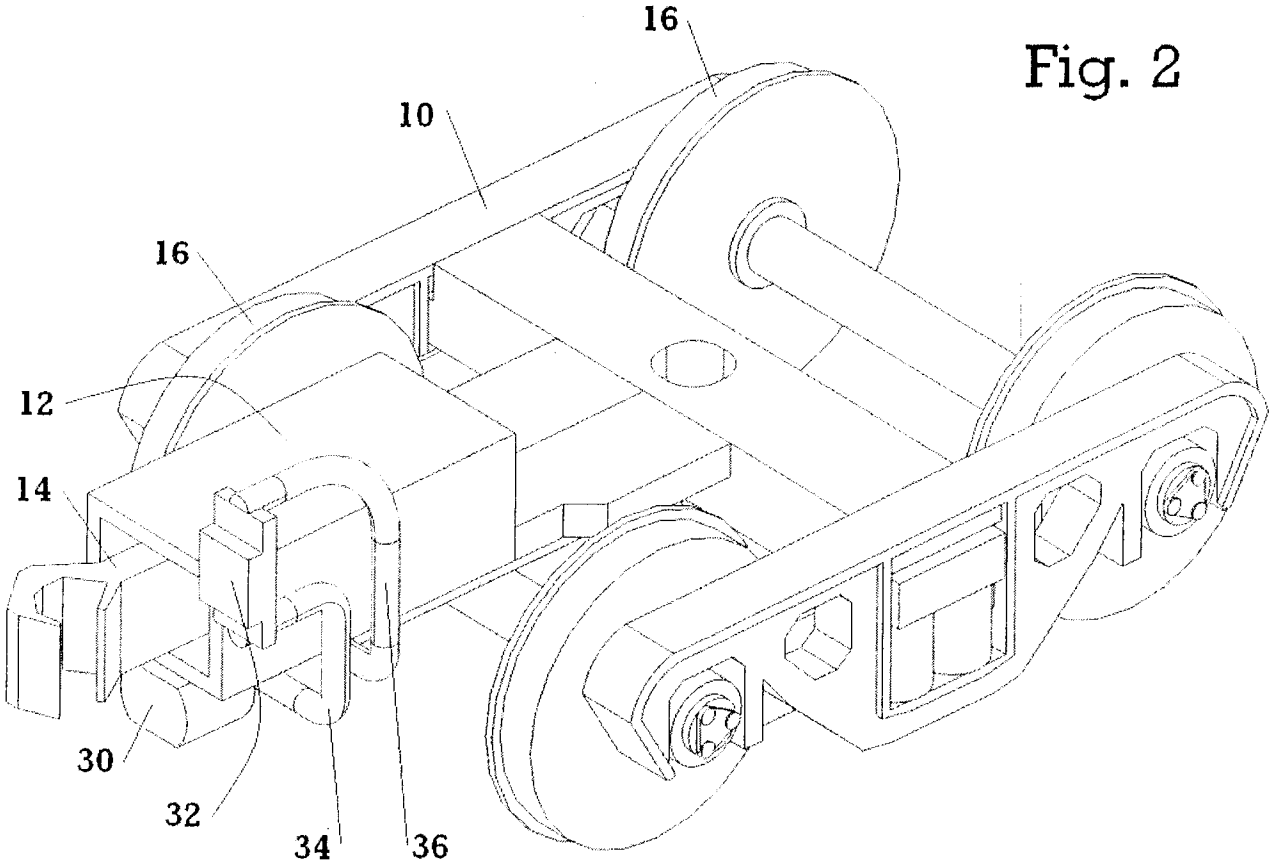
FIG. 2 is a perspective view of a possible embodiment of the device installed on a model railcar truck, showing the upper side of the truck.

Referring now to the figures, in FIG. 1 and FIG. 2 there is shown a model railcar truck 10, with integral coupler box 12 and associated coupler 14. The model railcar truck 10 is shown having two metal wheel/axle assemblies 16. Each wheel/axle assembly 16 has two electrically-isolated wheels that are insulated by the axle. A first metal wire 18 is connected to a first wiper 20, such as by a soldered connection, and a second metal wire 22 is connected to a second wiper 24. The wires 18, 22 may be made of copper or other electrically conductive material. During assembly, the wires 18, 22 are connected to a miniature bridge rectifier 26. The positive output pin of the bridge rectifier 26 is in turn connected in series first to a surface mount current limiting resistor 28, then to a blinking LED 30 and a surface mount LED 32, which are connected by two wires 34 and 36, and then to the negative pin of a bridge rectifier diode 26.

In FIG. 1, the first wiper 20 and the second wiper 24 are shown contacting the face or outboard surface of the metal wheel/axle 16, which forms the primary electrical contact for the electronic circuit that powers the model railroad car flashing rear end device. The first wiper 20 and the second wiper 24 each contact two wheels on one side, resulting in two separate points of electrical pickup on each rail, minimizing the effect of dirt or loss of contact with the powered rails. The wipers 20, 24 may be made of any type of electrically conductive material, which material may also be thin and flexible, springy, or resilient material. Some examples of possible materials are copper, brass, and phosphor bronze. In another possible embodiment, the wipers 20, 24 could be designed to contact the perimeter surface or tread of the wheels 16, either in addition to contacting the outboard surface of the wheels 16 or as an alternative.

In another embodiment, the miniature bridge rectifier 26 would be omitted. The first metal wire 18 would be connected to the surface mount current limiting resistor 28, and the second metal wire 22 connected to the surface mount LED 32.

In yet another embodiment, the blinking LED 30 would be omitted and a surface mount LED 32 with a built-in flashing circuit would be used. The surface mount LED wire 34 would be connected to the surface mount resistor 28 directly.

In another embodiment, both the miniature bridge rectifier 26 and the blinking LED 30 would both be omitted, and a surface mount LED 32 with a built-in flashing circuit would be used. The surface mount LED wire 34 would be connected to the surface mount resistor 28 directly. The first metal wire 18 would be connected to the surface mount current limiting resistor 28 and the second metal wire 22 connected to the surface mount LED 32.

Figure 3:
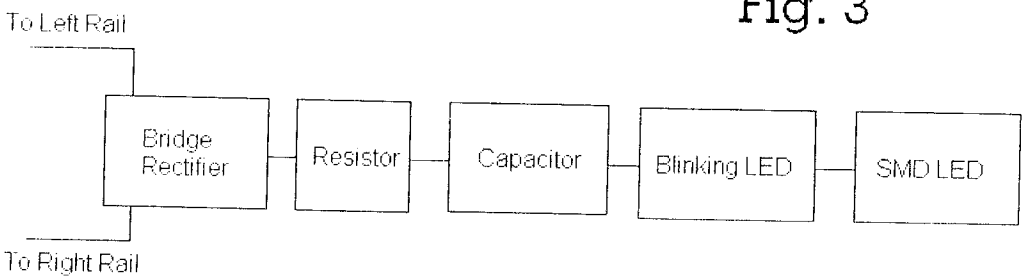
FIG. 3 is a schematic block diagram of the electronic components and circuit for a possible embodiment of the device.
Figure 4:
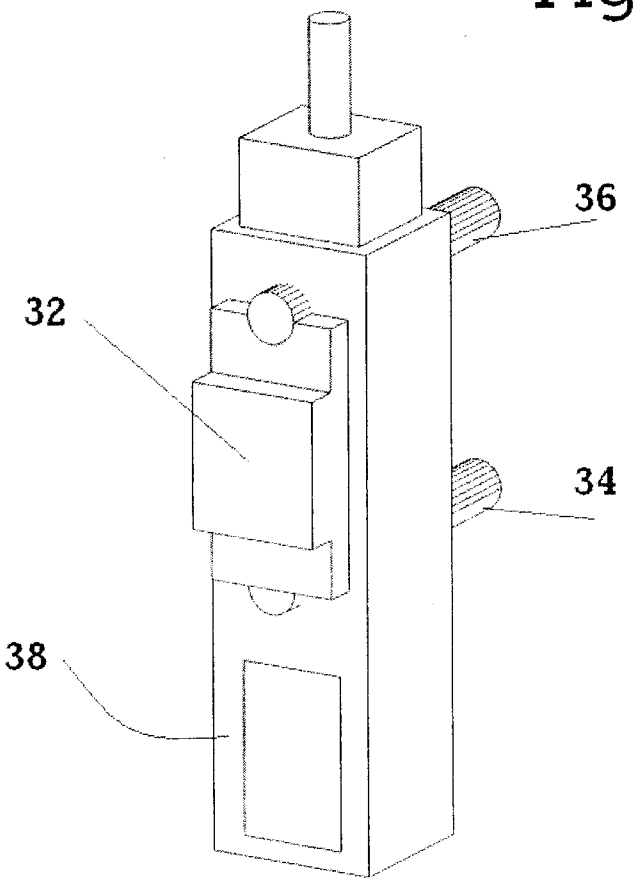
FIG. 4 is a perspective view of a housing for the flashing rear end device LED.

Referring now to FIG. 3, there is shown a block diagram for the electrical functions of the components. This drawing shows the power pickup from the metal wheel/axle 16 to the components of the electrical circuit. This circuit may be built from discrete components or a printed circuit board, or a combination of these parts, or by some other means of providing the required rectification, power conditioning, filtering and signal generation needed to produce the flashing effect for the flashing rear end device LED 32. The flashing rear end device surface mount LED 32 may be mounted in a housing 38 as seen in FIG. 4.

Figure 5:
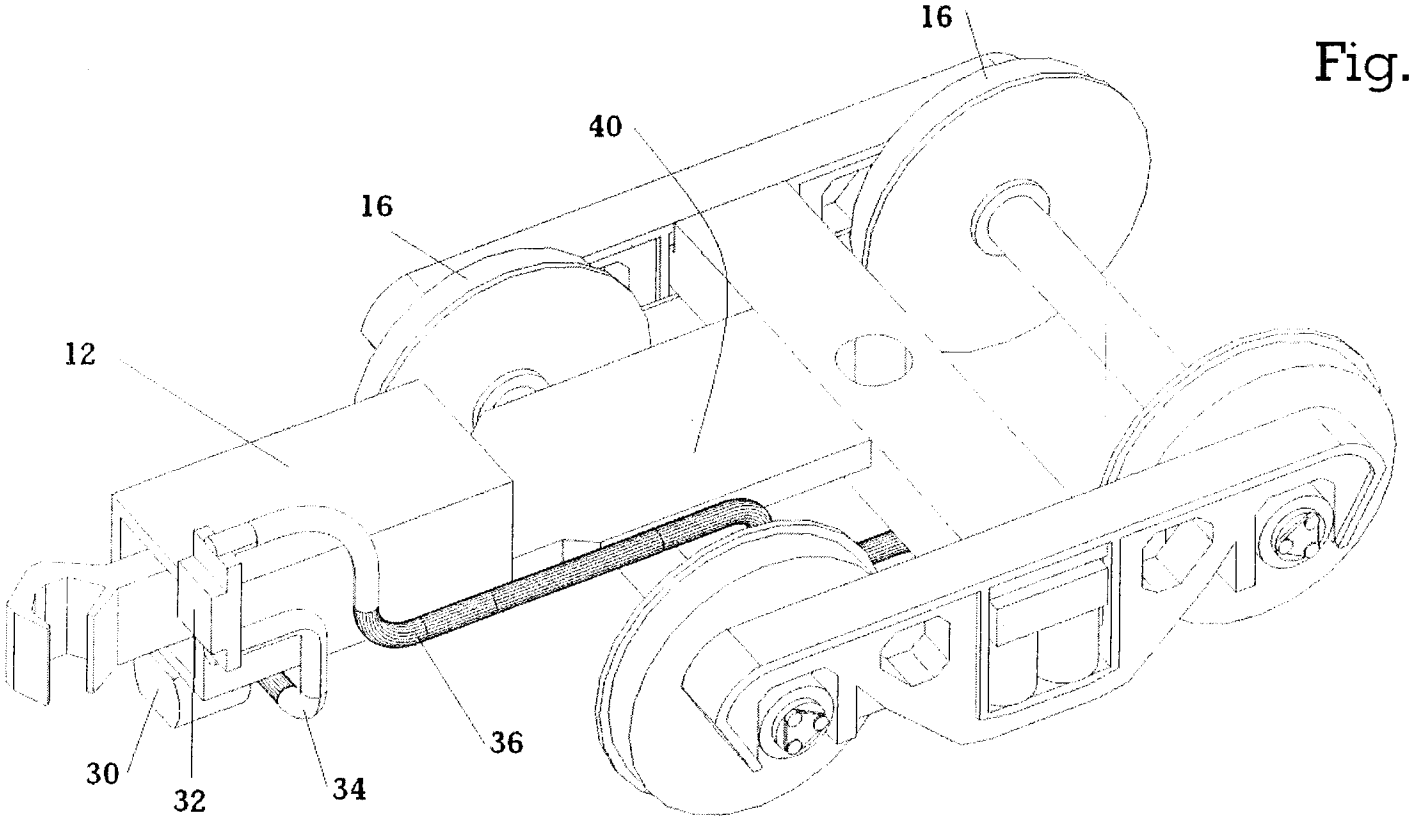
FIG. 5 is a perspective view showing a different installation of a possible embodiment of the device on a long extension truck.

Referring to FIG. 5, there is shown one possible embodiment of the present application mounted on a model railroad car truck with a long extension coupler box 40. This allows for one possible embodiment of the present application to be utilized under a model railroad car that requires a longer coupler to truck center length, such as a model 89 foot flat car, which in N scale is 6.67 inches long.

Figure 6:
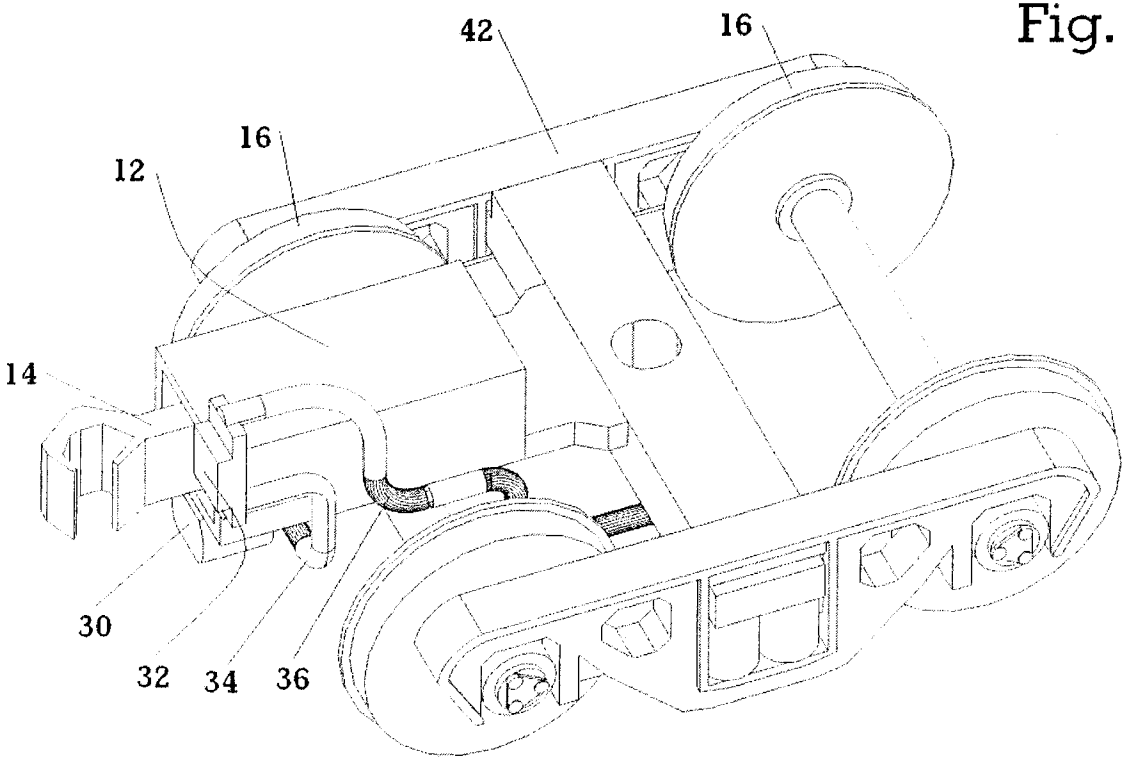
FIG. 6 is a perspective view showing a different installation of a possible embodiment of the device on a short extension truck.

Referring to FIG. 6, there is shown one possible embodiment of the present application mounted on a model railroad car truck with a short extension coupler box 42. This allows for one possible embodiment of the present application to be utilized under a model railroad car that requires a shorter coupler to truck center length, such as a model 30 foot tank car, which in N scale is 2.25 inches long.

Figure 7:
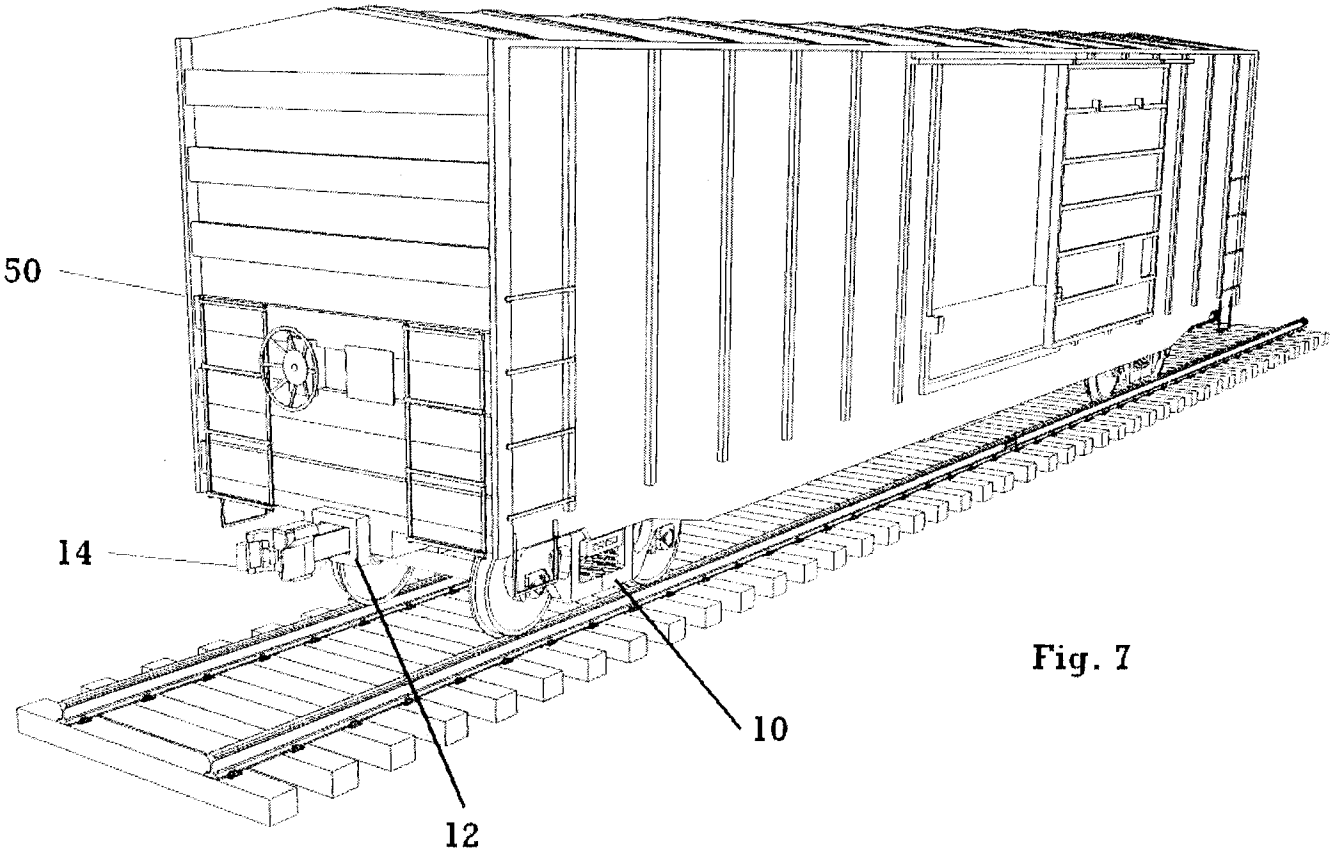
FIG. 7 is a perspective view showing a representative railcar on railroad track.

Referring to FIG. 7, there is shown a perspective view of a representative railcar on a railroad track, with the main components noted. The car body 50 sits upon two model railcar trucks 10, with one of the two couplers 14 located inside the coupler box 12 visible. The other coupler 14 is located on the other end of the car body 50.

Figure 8:
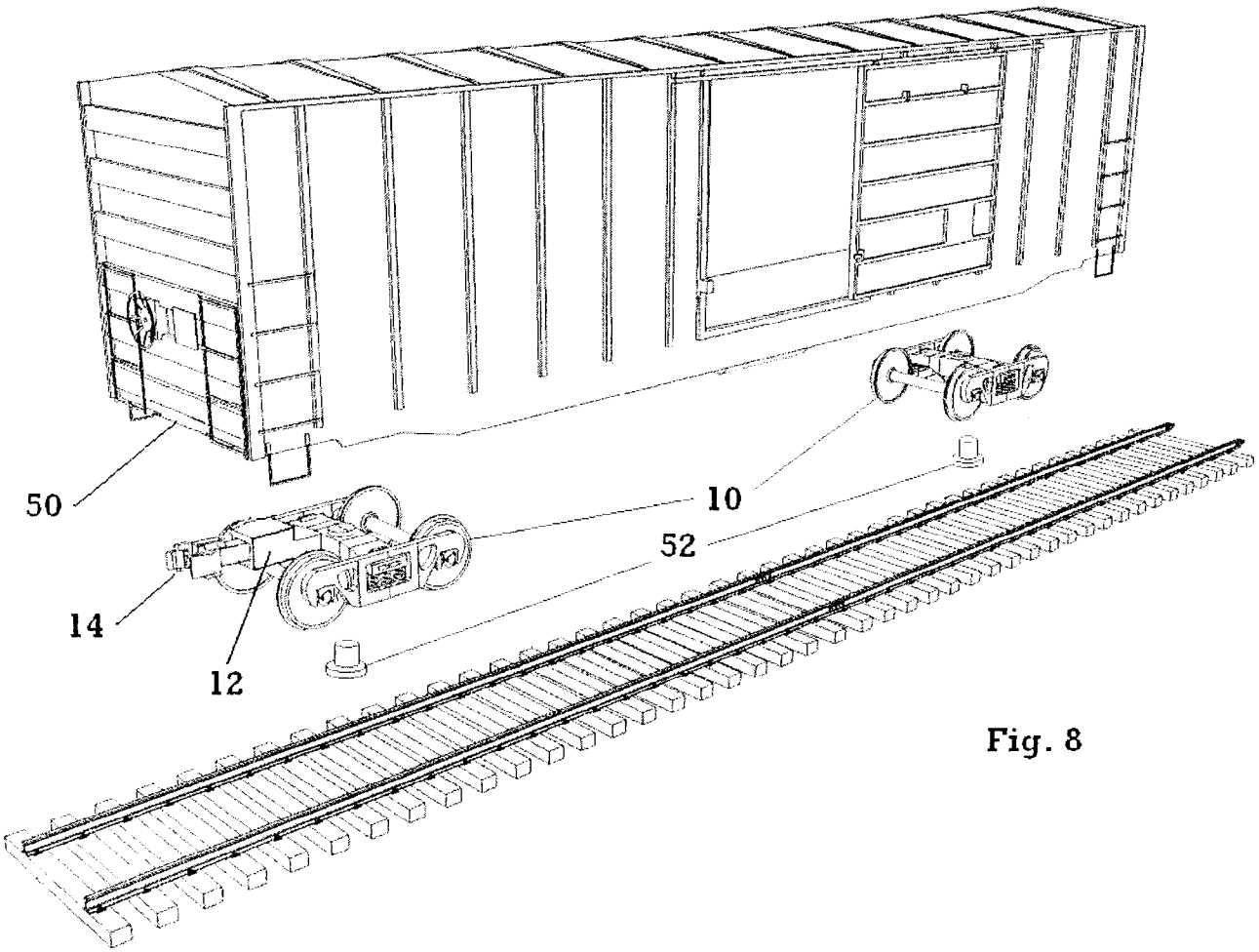
FIG. 8 is an exploded perspective view showing a representative railcar, with the main components noted.

Referring now to FIG. 8, there is show the same railcar as in FIG. 7 only in an exploded view, clearly showing the model railcar trucks 10. As can be seen, the coupler 14 is shown inside the coupler box 12 as part of the one-piece design model railcar truck 10. There can also be seen the truck retaining kingpin 52 which is inserted through a hole in the model railcar truck 10 as shown, and then inserted into the car body 50.

Figure 9:
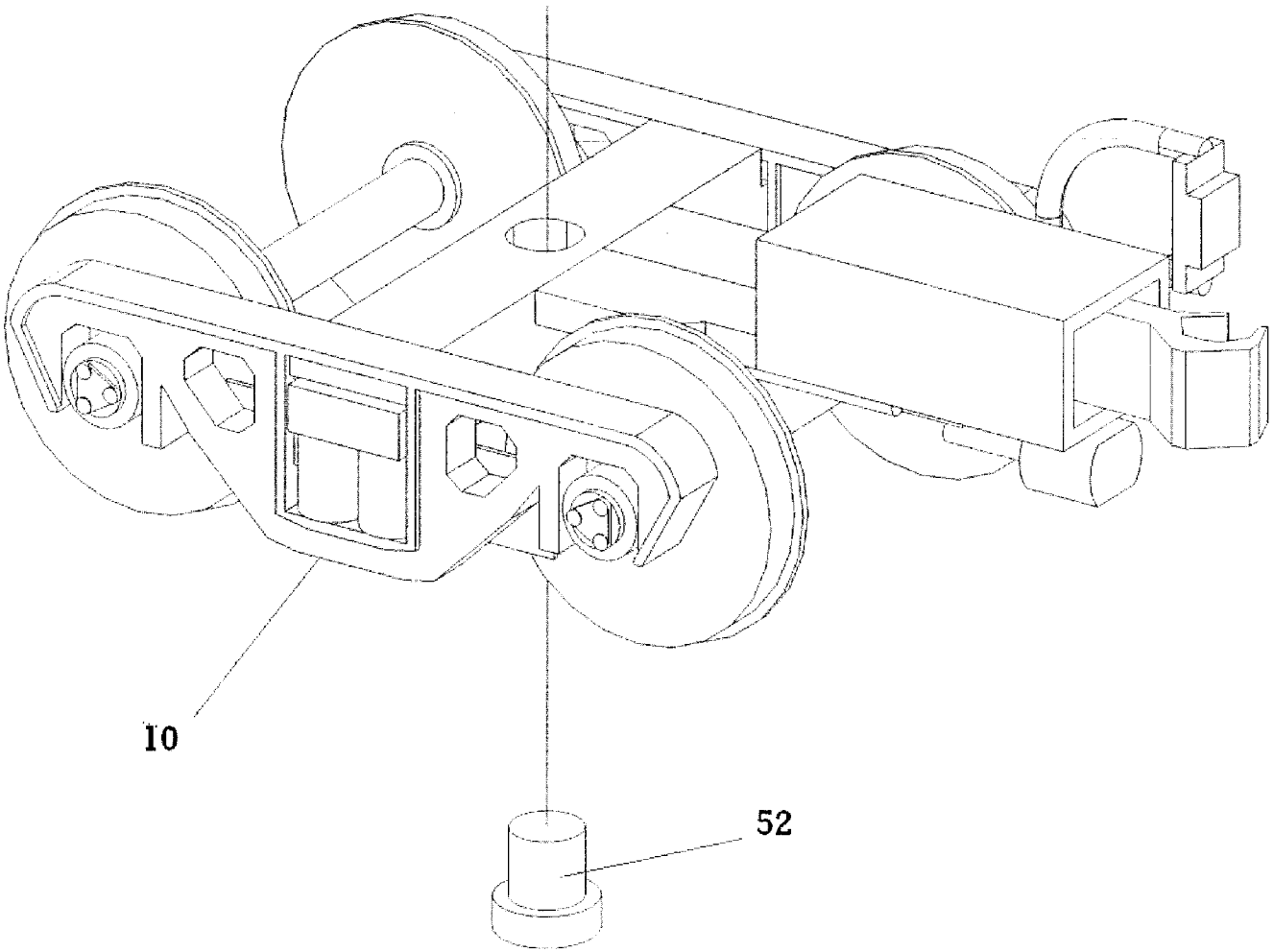
FIG. 9 is an exploded view of a possible embodiment of the device with the truck retaining kingpin.

Referring to FIG. 9, there is shown an exploded view of one possible embodiment of the present application with the truck-retaining kingpin 52. The truck-retaining kingpin 52 is inserted through a hole in the model railcar truck 10 as shown, and then inserted into the car body 50. The truck-retaining kingpin 52 is a friction fit pin, generally made of engineering plastic, that allows the model railcar truck 10 to pivot around the pin axis, yet remain attached to the car body 50.

The advantages of one possible embodiment of the present application are that it is fully contained on or about the surface of the model railcar truck and is easily portable. Moving the device from one model railcar to another requires no permanent or significant modification to any of the model railcars to which the device may be attached.

In one possible embodiment of the present application, installation on a model railcar is accomplished by removing the truck-retaining kingpin 52, removing the existing truck, placing the flashing rear end device truck assembly 10 on the car body 50, and re-inserting the truck-retaining kingpin 52.

Further, in one possible embodiment of the present application, the flashing rear end device truck assembly 10 is powered solely by electrical current and voltage from the model railroad track, via the wheel wipers, which contact the metal wheels, which contact the model railroad track rails. There is no other power source required, such as a battery, although a battery may be utilized.

Many model train systems are direct current (DC) train systems, which includes a power pack that provides direct current that powers the model locomotive and any devices that draw power from the tracks. For typical forward movement the right side rail is positive and the left side rail is negative. To reverse the train movement, the polarity is reversed, and thus the right side rail becomes negative and the left side rail becomes positive. The voltage supplied is usually between 0 and 10 volts, with a typical current of 1 amp or less. As discussed above, the flashing rear end device truck assembly draws power for the LED from the tracks. Consequently, in a direct current system, when the train movement, and thus the polarity, is reversed, the circuit to the LED is interrupted and the flashing rear end device ceases to light.

According to one possible embodiment, this problem may be overcome by incorporating a bridge rectifier into the flashing rear end device truck assembly. A bridge rectifier is used to convert alternating current to direct current, and most light emitting diodes need a bridge rectifier to light properly. The bridge rectifier would therefore be used to permit the operation of the flashing rear end device whether the train is being moved forward or backward.

Another model train system is digital command control (DCC). With the digital command control system, an alternating current is applied to the rails, generally with a maximum voltage of 16 volts and a current of 2 amps or more. Superimposed upon this alternating current is a digital signal that contains speed and direction information. The digital signal is directed to a device onboard each locomotive called a decoder. The decoder interprets the digital data and converts it to voltage, polarity, and current commands that are then carried out by the locomotive.

It was discovered that the DCC system, unlike the direct current system, advantageously permits constant operation of the flashing rear end device without the need for a bridge rectifier. To further explain, in DCC systems there is relatively high frequency of the alternation of the DCC current, which operates at 8,000 hertz or 8 kilohertz. As a result of this high frequency of alteration of the current, the flashing rear end device truck assembly appears to experience virtually or essentially bi-directional direct current. In other words, the current alternates so quickly that the flashing rear end device receives current regardless of the direction in which the train is traveling. There is essentially no need for the flashing rear end device truck assembly to interpret the digital signal, and the flashing rear end device truck assembly does not require a bridge rectifier.

The flashing rear end device truck assembly according to at least one possible embodiment utilizes a metal wheel set to get power from the rails. There are several examples of a metal wheel set, each with different advantages. One such example is a wheel with a large flat outside face, which large surface area provides excellent contact for electrical conduction. Another example is a wheel with a thinner outside face, which gives lower friction when rolling. Still another example is a wheel set that has a thinner outside face, but with a wider wheel tread, giving better wheel to rail contact. All of these examples can be utilized in at least one possible embodiment of the present application.

In at least one possible embodiment, the flashing rear end device truck assembly comprises a 1000 Ohm ¼ watt surface mount device (SMD) resistor, or a 1000 Ohm SMD resistor, which may be good for 0-20 volts, and may provide a maximum current of 20 milliamps to the LED. An LED, such as a 1208 size red SMD LED or smaller, could be used for the flashing rear end light, which size is selected to provide an appearance for N and Z scale trains that is essentially to scale with their larger, real-world counterparts. The LED is "dumb" in that it does not flash or blink on its own, so a control device must be utilized. In at least one possible embodiment, a control LED, such as the Kingbright T-1 size, 680 nm wavelength LED, could be utilized. The Kingbright T-1 LED has a flash rate of one hertz, that is, one blink or flash per second, which is also very close to the flash rate of a real train. The flash rate of the Kingbright T-1 combined with the size of the 1208 LED creates a visual impression that is similar to real-world trains in terms of size and flash rate. Instead of using a "dumb" LED and control device, an LED that has a built-in blink or flash control could also be used. The wiring to connect the various components of the flashing rear end device truck assembly could be common copper wire, magnet wire, or other suitable wire of various gauges, such as 30 gauge. A miniature or sub-miniature bridge rectifier could be incorporated for direct current systems. The location of the LED can be chosen for proper appearance, and the flashing rear end device truck assembly could have a housing of sorts which matches real-world end-of-train device boxes.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention as claimed.

An example of an HO-scale model railroad car and components thereof may be found in U.S. Pat. No. 7,549,609 to Ring, which is incorporated by reference herein. Although N scale and Z scale model railroad cars are discussed herein with respect to the flashing rear end device truck assembly 10, it is possible that the flashing rear end device truck assembly 10 could be adapted for use in other scales of model railroad cars, such as HO scale.

Some examples of direct power modules and micro bridge rectifiers which could be utilized or adapted for use in at least one possible embodiment of the present application are manufactured and/or sold by N'gineering (www.ngineering-.com/accessories.htm), 20024 NE Bridlewood Road, Battle Ground, Wash. 98604 USA. Some examples of model railcar trucks which could be utilized or adapted for use in at least one possible embodiment of the present application are manufactured and/or sold by Micro Trains Company (www-.micro-trains.com/trucks_n.php), 351 Rogue River Parkway, Talent, Oreg. 97540-1200 USA. Some examples of LED's and SMD LED's which could be utilized or adapted for use in at least one possible embodiment of the present application are manufactured and/or sold by Kingbright USA (www.k-ingbrightusa.com/default.asp), 225 Brea Canyon Road, City of Industry, Calif. 91789, USA. Some examples of model train wheels which could be utilized or adapted for use in at least one possible embodiment of the present application are manufactured and/or sold by BLMA (www.blmamod-els.com), 302 District Ct. Fullerton, Calif. 92832, Fox Valley Models (www.foxvalleymodels.com), P.O. Box 1970, Des Plaines, Ill. 60017, and InterMountain Railway Company (www.intermountain-railway.com) P.O. Box 839, Longmont, Colo. 80502-0839.

One feature or aspect of an embodiment is believed at the time of the filing of this patent application to possibly reside broadly in a method of operating an N-scale or Z-scale model railroad truck assembly, said truck assembly comprising: a truck body comprising an integral coupler box and coupler; a front metal wheel assembly and a rear metal wheel assembly, each comprising an axle and two electrically-isolated wheels; a first wiper and a second wiper, each comprising a thin, flat strip of electrically conductive material; said first wiper being mounted solely on said truck body and being disposed to contact the outer faces of two adjacent wheels, one from each wheel assembly, disposed on a first side of said truck body; said second wiper being mounted solely on said truck body and being disposed to contact the outer faces of two adjacent wheels, one from each wheel assembly, disposed on a second side of said truck body opposite said first side; a flashing rear end device being mounted solely on said truck body and comprising a flashing LED arrangement operatively connected to said wipers; said flashing LED arrangement comprising an LED and a control device being configured to control flashing of said LED; and each of said wipers being configured to conduct electric current traveling through model railroad tracks and said wheels to said LED arrangement to operate said flashing rear end device, and being configured to minimize the effect of dirt on said wheels and/or loss of contact with the powered rails by contacting a portion of the outer faces of said wheels with a flat surface portion of each of said wipers; said method comprising the steps of: placing said wheels on a model railroad track; supplying power to said model railroad track; conducting power from said model railroad track through said wheels, to said wipers in contact with the outer faces of said wheels, and then to said LED arrangement to light said LED; flashing said LED; and minimizing the effect of dirt on said wheels and/or loss of contact with the powered rails by contacting a portion of the outer faces of said wheels with a flat surface portion of each of said wipers.

Another feature or aspect of an embodiment is believed at the time of the filing of this patent application to possibly reside broadly in the method wherein said flash rate is between 0.5 to 1 hertz, or between 0.5 to 1 flash per second.

Yet another feature or aspect of an embodiment is believed at the time of the filing of this patent application to possibly reside broadly in the method wherein said flashing rear end device is powered solely by current received from said model railroad track.

Still another feature or aspect of an embodiment is believed at the time of the filing of this patent application to possibly reside broadly in the method wherein said model railroad truck assembly comprises a bridge rectifier mounted on said truck body and configured to rectify incoming electric current, and said method further comprises: supplying direct current to said model railroad tracks and thus to said flashing rear end device; reversing the polarity of the electric current; and rectifying the electric current with said bridge rectifier and thereby maintaining operation of said flashing rear end device.

A further feature or aspect of an embodiment is believed at the time of the filing of this patent application to possibly reside broadly in the method wherein said method further comprises supplying alternating current in a digital command control system at a sufficiently high frequency of alternation and thereby maintaining operation of said flashing rear end device.

Another feature or aspect of an embodiment is believed at the time of the filing of this patent application to possibly reside broadly in the method wherein said method further comprises removably connecting a model railroad car to said truck body by inserting a connecting pin through a hole in said truck body and into a hole in said model railroad car, and thereby forming a friction fit between said connecting pin and said model railroad car.

One feature or aspect of an embodiment is believed at the time of the filing of this patent application to possibly reside broadly in an N-scale or Z-scale model railroad truck assembly, said truck assembly comprising: a truck body comprising an integral coupler box and coupler; a front metal wheel assembly and a rear metal wheel assembly, each comprising an axle and two electrically-isolated wheels; a first wiper and a second wiper, each comprising a thin, flat strip of electrically conductive material; said first wiper being mounted solely on said truck body and being disposed to contact the outer faces of two adjacent wheels, one from each wheel assembly, disposed on a first side of said truck body; said second wiper being mounted solely on said truck body and being disposed to contact the outer faces of two adjacent wheels, one from each wheel assembly, disposed on a second side of said truck body opposite said first side; a flashing rear end device being mounted solely on said truck body and comprising a flashing LED arrangement operatively connected to said wipers; said flashing LED arrangement comprising an LED and a control device being configured to control flashing of said LED; and each of said wipers being configured to conduct electric current traveling through model railroad tracks and said wheels to said LED arrangement to operate said flashing rear end device, and being configured to minimize the effect of dirt on said wheels and/or loss of contact with the powered rails by contacting a portion of the outer faces of said wheels with a flat surface portion of each of said wipers.

Another feature or aspect of an embodiment is believed at the time of the filing of this patent application to possibly reside broadly in the N-scale or Z-scale model railroad truck assembly wherein said control device is configured to control flashing of said LED at a flash rate of between 0.5 to 1 hertz, or between 0.5 to 1 flash per second.

Yet another feature or aspect of an embodiment is believed at the time of the filing of this patent application to possibly reside broadly in the N-scale or Z-scale model railroad truck assembly wherein said flashing rear end device is configured to be powered solely by current received from a model railroad track.

Still another feature or aspect of an embodiment is believed at the time of the filing of this patent application to possibly reside broadly in the N-scale or Z-scale model railroad truck assembly wherein said model railroad truck assembly comprises a bridge rectifier mounted on said truck body and configured to rectify incoming electric current to permit operation of said flashing rear end device upon a reversal of the polarity of the electric current.

A further feature or aspect of an embodiment is believed at the time of the filing of this patent application to possibly reside broadly in the N-scale or Z-scale model railroad truck assembly wherein said truck body comprises a connecting pin configured to removably connect a model railroad car to said truck body by a friction fit between said connecting pin and a model railroad car.

One feature or aspect of an embodiment is believed at the time of the filing of this patent application to possibly reside broadly in an N-scale or Z-scale model railroad truck assembly, said truck assembly comprising: a truck body; a front metal wheel assembly and a rear metal wheel assembly, each comprising an axle and two electrically-isolated wheels; a first wiper and a second wiper, each comprising a thin, flat strip of electrically conductive material; said first wiper being disposed to contact a portion of two adjacent wheels, one from each wheel assembly, disposed on a first side of said truck body; said second wiper being disposed to contact a portion of two adjacent wheels, one from each wheel assembly, disposed on a second side of said truck body opposite said first side; a flashing rear end device comprising a flashing LED arrangement operatively connected to said wipers; said flashing LED arrangement comprising an LED and a control device being configured to control flashing of said LED; and each of said wipers being configured to conduct electric current traveling through model railroad tracks and said wheels to said LED arrangement to operate said flashing rear end device.

The components disclosed in the various publications, disclosed or incorporated by reference herein, may possibly be used in possible embodiments of the present invention, as well as equivalents thereof.

The purpose of the statements about the technical field is generally to enable the Patent and Trademark Office and the public to determine quickly, from a cursory inspection, the nature of this patent application. The description of the technical field is believed, at the time of the filing of this patent application, to adequately describe the technical field of this patent application. However, the description of the technical field may not be completely applicable to the claims as originally filed in this patent application, as amended during prosecution of this patent application, and as ultimately allowed in any patent issuing from this patent application. Therefore, any statements made relating to the technical field are not intended to limit the claims in any manner and should not be interpreted as limiting the claims in any manner.

The appended drawings in their entirety, including all dimensions, proportions and/or shapes in at least one embodiment of the invention, are accurate and are hereby included by reference into this specification.

The background information is believed, at the time of the filing of this patent application, to adequately provide background information for this patent application. However, the background information may not be completely applicable to the claims as originally filed in this patent application, as amended during prosecution of this patent application, and as ultimately allowed in any patent issuing from this patent application. Therefore, any statements made relating to the background information are not intended to limit the claims in any manner and should not be interpreted as limiting the claims in any manner.

All, or substantially all, of the components and methods of the various embodiments may be used with at least one embodiment or all of the embodiments, if more than one embodiment is described herein.

The purpose of the statements about the object or objects is generally to enable the Patent and Trademark Office and the public to determine quickly, from a cursory inspection, the nature of this patent application. The description of the object or objects is believed, at the time of the filing of this patent application, to adequately describe the object or objects of this patent application. However, the description of the object or objects may not be completely applicable to the claims as originally filed in this patent application, as amended during prosecution of this patent application, and as ultimately allowed in any patent issuing from this patent application. Therefore, any statements made relating to the object or objects are not intended to limit the claims in any manner and should not be interpreted as limiting the claims in any manner.

All of the patents, patent applications and publications recited herein, and in the Declaration attached hereto, are hereby incorporated by reference as if set forth in their entirety herein.

The summary is believed, at the time of the filing of this patent application, to adequately summarize this patent application. However, portions or all of the information contained in the summary may not be completely applicable to the claims as originally filed in this patent application, as amended during prosecution of this patent application, and as ultimately allowed in any patent issuing from this patent application. Therefore, any statements made relating to the summary are not intended to limit the claims in any manner and should not be interpreted as limiting the claims in any manner.

It will be understood that any or all the examples of patents, published patent applications, and other documents which are included in this application and including those which are referred to in paragraphs which state "Some examples of . . . which may possibly be used in at least one possible embodiment of the present application . . . " may possibly not be used or useable in any one or more or any embodiments of the application.

The sentence immediately above relates to patents, published patent applications and other documents either incorporated by reference or not incorporated by reference.

All of the references and documents, cited in any of the documents cited herein, are hereby incorporated by reference as if set forth in their entirety herein. All of the documents cited herein, referred to in the immediately preceding sentence, include all of the patents, patent applications and publications cited anywhere in the present application.

The description of the embodiment or embodiments is believed, at the time of the filing of this patent application, to adequately describe the embodiment or embodiments of this patent application. However, portions of the description of the embodiment or embodiments may not be completely applicable to the claims as originally filed in this patent application, as amended during prosecution of this patent application, and as ultimately allowed in any patent issuing from this patent application. Therefore, any statements made relating to the embodiment or embodiments are not intended to limit the claims in any manner and should not be interpreted as limiting the claims in any manner.

The details in the patents, patent applications and publications may be considered to be incorporable, at applicant's option, into the claims during prosecution as further limitations in the claims to patentably distinguish any amended claims from any applied prior art.

The purpose of the title of this patent application is generally to enable the Patent and Trademark Office and the public to determine quickly, from a cursory inspection, the nature of this patent application. The title is believed, at the time of the filing of this patent application, to adequately reflect the general nature of this patent application. However, the title may not be completely applicable to the technical field, the object or objects, the summary, the description of the embodiment or embodiments, and the claims as originally filed in this patent application, as amended during prosecution of this patent application, and as ultimately allowed in any patent issuing from this patent application. Therefore, the title is not intended to limit the claims in any manner and should not be interpreted as limiting the claims in any manner.

The abstract of the disclosure is submitted herewith as required by 37 C.F.R. §1.72(b). As stated in 37 C.F.R. §1.72 (b):

A brief abstract of the technical disclosure in the specification must commence on a separate sheet, preferably following the claims, under the heading "Abstract of the Disclosure." The purpose of the abstract is to enable the Patent and Trademark Office and the public generally to determine quickly from a cursory inspection the nature and gist of the technical disclosure. The abstract shall not be used for interpreting the scope of the claims.

Therefore, any statements made relating to the abstract are not intended to limit the claims in any manner and should not be interpreted as limiting the claims in any manner.

The embodiments of the invention described herein above in the context of the preferred embodiments are not to be taken as limiting the embodiments of the invention to all of the provided details thereof, since modifications and variations thereof may be made without departing from the spirit and scope of the embodiments of the invention.

What is claimed is:

1. A method of operating an N-scale or Z-scale model railroad truck assembly, said truck assembly comprising:

a truck body comprising an integral coupler box and coupler;

a front metal wheel assembly and a rear metal wheel assembly, each comprising an axle and two electrically-isolated wheels;

each of said wheels comprising a perimeter surface configured to contact the rails of a model railroad track, and an outer face disposed perpendicular to said perimeter surface and facing away from said axle;

a first wiper and a second wiper, each comprising a thin, flat strip of electrically conductive material;

said first wiper being mounted solely on said truck body and being disposed to contact the outer faces of two adjacent wheels, one from each wheel assembly, disposed on a first side of said truck body;

said second wiper being mounted solely on said truck body and being disposed to contact the outer faces of two adjacent wheels, one from each wheel assembly, disposed on a second side of said truck body opposite said first side;

a flashing rear end device being mounted solely on said truck body and comprising a flashing LED arrangement operatively connected to said wipers;

said flashing LED arrangement comprising an LED and a control device being configured to control flashing of said LED; and each of said wipers being configured to conduct electric current traveling through model railroad tracks and said wheels to said LED arrangement to operate said flashing rear end device, and being configured to minimize the effect of dirt on said wheels and/or loss of contact with the powered rails by contacting a portion of the outer faces of said wheels with a flat surface portion of each of said wipers; said method comprising the steps of:

placing said wheels on a model railroad track;

supplying power to said model railroad track;

conducting power from said model railroad track through said wheels, to said wipers in contact with the outer faces of said wheels, and then to said LED arrangement to light said LED;

flashing said LED; and minimizing the effect of dirt on said wheels and/or loss of contact with the powered rails by contacting a portion of the outer faces of said wheels with a flat surface portion of each of said wipers.

2. The method according to claim 1, wherein said flash rate is between 0.5 to 1 hertz, or between 0.5 to 1 flash per second.

3. The method according to claim 2, wherein said flashing rear end device is powered solely by current received from said model railroad track.

4. The method according to claim 3, wherein said model railroad truck assembly comprises a bridge rectifier mounted on said truck body and configured to rectify incoming electric current, and said method further comprises:

supplying direct current to said model railroad tracks and thus to said flashing rear end device;

reversing the polarity of the electric current; and rectifying the electric current with said bridge rectifier and thereby maintaining operation of said flashing rear end device.

5. The method according to claim 3, wherein said method further comprises supplying alternating current in a digital command control system at a sufficiently high frequency of alternation and thereby maintaining operation of said flashing rear end device.

6. The method according to claim 3, wherein said method further comprises removably connecting a model railroad car to said truck body by inserting a friction fit pin through a hole in said truck body and into a hole in said model railroad car, and thereby forming a friction fit between said friction fit pin and said model railroad car.

7. An N-scale or Z-scale model railroad truck assembly, said truck assembly comprising:

a truck body comprising an integral coupler box and coupler;

a front metal wheel assembly and a rear metal wheel assembly, each comprising an axle and two electrically-isolated wheels;

each of said wheels comprising a perimeter surface configured to contact the rails of a model railroad track, and an outer face disposed perpendicular to said perimeter surface and facing away from said axle;

a first wiper and a second wiper, each comprising a thin, flat strip of electrically conductive material;

said first wiper being mounted solely on said truck body and being disposed to contact the outer faces of two adjacent wheels, one from each wheel assembly, disposed on a first side of said truck body;

said second wiper being mounted solely on said truck body and being disposed to contact the outer faces of two adjacent wheels, one from each wheel assembly, disposed on a second side of said truck body opposite said first side;

a flashing rear end device being mounted solely on said truck body and comprising a flashing LED arrangement operatively connected to said wipers;

said flashing LED arrangement comprising an LED and a control device being configured to control flashing of said LED; and each of said wipers being configured to conduct electric current traveling through model railroad tracks and said wheels to said LED arrangement to operate said flashing rear end device, and being configured to minimize the effect of dirt on said wheels and/or loss of contact with the powered rails by contacting a portion of the outer faces of said wheels with a flat surface portion of each of said wipers.

8. The N-scale or Z-scale model railroad truck assembly according to claim 7, wherein said control device is configured to control flashing of said LED at a flash rate of between 0.5 to 1 hertz, or between 0.5 to 1 flash per second.

9. The N-scale or Z-scale model railroad truck assembly according to claim 8, wherein said flashing rear end device is configured to be powered solely by current received from a model railroad track.

10. The N-scale or Z-scale model railroad truck assembly according to claim 9, wherein said model railroad truck assembly comprises a bridge rectifier mounted on said truck body and configured to rectify incoming electric current to permit operation of said flashing rear end device upon a reversal of the polarity of the electric current.

11. The N-scale or Z-scale model railroad truck assembly according to claim 9, wherein said truck body comprises a friction fit pin configured to removably connect a model railroad car to said truck body by a friction fit between said friction fit pin and a model railroad car.

12. The N-scale or Z-scale model railroad truck assembly according to claim 7, wherein said flashing rear end device is configured to be powered solely by current received from a model railroad track.

13. The N-scale or Z-scale model railroad truck assembly according to claim 7, wherein said model railroad truck assembly comprises a bridge rectifier mounted on said truck body and configured to rectify incoming electric current to permit operation of said flashing rear end device upon a reversal of the polarity of the electric current.

14. The N-scale or Z-scale model railroad truck assembly according to claim 7, wherein said truck body comprises a friction fit pin configured to removably connect a model railroad car to said truck body by a friction fit between said friction fit pin and a model railroad car.

15. An N-scale or Z-scale model railroad truck assembly, said truck assembly comprising:

a truck body;

a front metal wheel assembly and a rear metal wheel assembly, each comprising an axle and two electrically-isolated wheels;

each of said wheels comprising a perimeter surface configured to contact the rails of a model railroad track, and an outer face disposed transverse to said perimeter surface and facing away from said axle;

a first wiper and a second wiper, each comprising a thin, flat strip of electrically conductive material;

said first wiper being disposed to contact outer faces of two adjacent wheels, one from each wheel assembly, disposed on a first side of said truck body;

said second wiper being disposed to contact outer faces of two adjacent wheels, one from each wheel assembly, disposed on a second side of said truck body opposite said first side;

a flashing rear end device comprising a flashing LED arrangement operatively connected to said wipers;

said flashing LED arrangement comprising an LED and a control device being configured to control flashing of said LED; and each of said wipers being configured to conduct electric current traveling through model railroad tracks and said wheels to said LED arrangement to operate said flashing rear end device.

16. The N-scale or Z-scale model railroad truck assembly according to claim 15, wherein said control device is configured to control flashing of said LED at a flash rate of between 0.5 to 1 hertz, or between 0.5 to 1 flash per second.

17. The N-scale or Z-scale model railroad truck assembly according to claim 16, wherein said flashing rear end device is configured to be powered solely by current received from a model railroad track.

18. The N-scale or Z-scale model railroad truck assembly according to claim 17, wherein said model railroad truck assembly comprises a bridge rectifier mounted on said truck body and configured to rectify incoming electric current to permit operation of said flashing rear end device upon a reversal of the polarity of the electric current.

19. The N-scale or Z-scale model railroad truck assembly according to claim 17, wherein said truck body comprises a friction fit pin configured to removably connect a model railroad car to said truck body by a friction fit between said friction fit pin and a model railroad car.

20. The N-scale or Z-scale model railroad truck assembly according to claim 15, wherein said flashing rear end device is configured to be powered solely by current received from a model railroad track.

* * * * *